US010132529B2

(12) United States Patent
Vaisman et al.

(10) Patent No.: US 10,132,529 B2
(45) Date of Patent: Nov. 20, 2018

(54) THERMAL MANAGEMENT SYSTEM CONTROLLING DYNAMIC AND STEADY STATE THERMAL LOADS

(71) Applicants: Rolls-Royce Corporation, Indianapolis, IN (US); Rolls-Royce North American Technologies, Inc., Indianapolis, IN (US)

(72) Inventors: Igor Vaisman, Carmel, IN (US); Steve T. Gagne, Avon, IN (US); Kyle Burkholder, Indianapolis, IN (US)

(73) Assignees: Rolls-Royce Corporation, Indianapolis, IN (US); Rolls-Royce North American Technologies, Inc., Indianapolis, IN (US)

( * ) Notice: Subject to any disclaimer, the term of this patent is extended or adjusted under 35 U.S.C. 154(b) by 289 days.

(21) Appl. No.: 15/010,296

(22) Filed: Jan. 29, 2016

(65) Prior Publication Data

US 2017/0219253 A1 Aug. 3, 2017
US 2018/0045432 A9 Feb. 15, 2018

Related U.S. Application Data

(63) Continuation-in-part of application No. 14/109,416, filed on Dec. 17, 2013, now Pat. No. 9,482,451.
(Continued)

(51) Int. Cl.
*F25B 1/00* (2006.01)
*F25B 9/00* (2006.01)
(Continued)

(52) U.S. Cl.
CPC ..... *F25B 9/008* (2013.01); *F25B 1/10* (2013.01); *F25B 11/02* (2013.01); *F25B 25/005* (2013.01);
(Continued)

(58) Field of Classification Search
CPC .. F25B 9/008; F25B 1/005; F25B 1/10; F25B 49/02; F25B 41/00; F25B 25/005;
(Continued)

(56) References Cited

U.S. PATENT DOCUMENTS 2,963,879 A 12/1960 Paravicini
3,153,331 A 10/1964 Rogers
(Continued)

FOREIGN PATENT DOCUMENTS

EP 1762491 A2 3/2007
EP 2019272 A2 1/2009
(Continued)

OTHER PUBLICATIONS

European Search Report for App. No. EP16152788.
International Search Report PCT/US2013/078155 dated Oct. 17, 2014.

*Primary Examiner* — Len Tran
*Assistant Examiner* — Kirstin Oswald
(74) *Attorney, Agent, or Firm* — Fishman Stewart PLLC

(57) ABSTRACT

A thermal management system includes a closed dynamic cooling circuit, and a closed first steady-state cooling circuit. Each circuit has its own compressor, heat rejection exchanger, and expansion device. A thermal energy storage (TES) system is configured to receive a dynamic load and thermally couple the dynamic cooling circuit and the first steady-state cooling circuit. The dynamic cooling circuit is configured to cool the TES to fully absorb thermal energy received by the TES when a dynamic thermal load is ON, and the steady-state cooling circuit is configured to cool the TES when the dynamic thermal load is OFF.

19 Claims, 9 Drawing Sheets

Related U.S. Application Data

(60) Provisional application No. 62/109,699, filed on Jan. 30, 2015, provisional application No. 61/785,900, filed on Mar. 14, 2013.

(51) Int. Cl.

| | |
|---|---|
| ***F25B 1/10*** | (2006.01) |
| ***F25B 11/02*** | (2006.01) |
| ***F25B 25/00*** | (2006.01) |
| ***F25B 41/00*** | (2006.01) |
| ***F25B 49/02*** | (2006.01) |
| *F25B 5/02* | (2006.01) |
| *F25B 40/00* | (2006.01) |
| *F25B 41/04* | (2006.01) |

(52) U.S. Cl.

CPC ..... *F25B 41/00* (2013.01); *F25B 49/02* (2013.01); *F25B 5/02* (2013.01); *F25B 40/00* (2013.01); *F25B 41/04* (2013.01); *F25B 2309/061* (2013.01); *F25B 2341/0011* (2013.01); *F25B 2400/0401* (2013.01); *F25B 2400/0409* (2013.01); *F25B 2400/0411* (2013.01); *F25B 2400/061* (2013.01); *F25B 2400/072* (2013.01); *F25B 2400/13* (2013.01); *F25B 2400/14* (2013.01); *F25B 2400/24* (2013.01)

(58) Field of Classification Search

CPC ..... F25B 11/02; F25B 2400/0411; F25B 2400/0409; F25B 2400/0401; F25B 2400/24; F25B 2309/061; F25B 2400/14; F25B 41/04; F25B 2400/13; F25B 40/00; F25B 2400/072; F25B 2400/061; F25B 5/02; F25B 2341/0011

USPC ..... 62/238.1, 87

See application file for complete search history.

(56) References Cited

U.S. PATENT DOCUMENTS

| | | | | |
|---|---|---|---|---|
| 3,978,684 | A * | 9/1976 | Taylor | F25B 13/00 62/324.3 |
| 4,205,532 | A | 6/1980 | Brenan | |
| 4,434,624 | A * | 3/1984 | Cronin | B64D 13/06 62/172 |
| 5,899,085 | A * | 5/1999 | Williams | B64D 13/06 62/236 |
| 6,516,623 | B1 * | 2/2003 | Collier | B60H 1/00507 62/238.7 |
| 6,644,062 | B1 | 11/2003 | Hays | |
| 6,647,742 | B1 | 11/2003 | Neiter et al. | |
| 6,694,763 | B2 | 2/2004 | Howard | |
| 6,698,214 | B2 | 3/2004 | Chordia | |
| 6,813,895 | B2 | 11/2004 | Eisenhower et al. | |
| 6,898,941 | B2 | 5/2005 | Sienel | |
| 7,000,413 | B2 | 2/2006 | Chen et al. | |
| 7,159,409 | B2 | 1/2007 | Manole | |
| 7,299,619 | B2 | 11/2007 | Briesch et al. | |
| 7,424,807 | B2 | 9/2008 | Sienel | |
| 7,621,137 | B2 | 11/2009 | Aflekt et al. | |
| 7,685,839 | B2 | 3/2010 | Gu | |
| 7,721,569 | B2 | 5/2010 | Manole | |
| 7,818,971 | B2 | 10/2010 | Yamaguchi et al. | |
| 7,818,978 | B2 | 10/2010 | Ducoulombier et al. | |
| 8,196,421 | B2 | 6/2012 | Bush et al. | |
| 8,316,654 | B2 * | 11/2012 | Heinbokel | F25B 7/00 62/498 |
| 8,327,651 | B2 | 12/2012 | Finney et al. | |
| 8,418,482 | B2 | 4/2013 | Bush et al. | |
| 8,424,326 | B2 | 4/2013 | Mitra et al. | |
| 8,857,186 | B2 | 10/2014 | Held | |
| 2003/0005718 | A1 | 1/2003 | Mitani et al. | |
| 2004/0159119 | A1 * | 8/2004 | Hu | B64D 13/00 62/435 |
| 2005/0103487 | A1 | 5/2005 | Aflekt et al. | |
| 2006/0064147 | A1 * | 3/2006 | Almqvist | A61F 7/02 607/108 |
| 2006/0162371 | A1 * | 7/2006 | Lui | B64D 13/06 62/402 |
| 2007/0068178 | A1 | 3/2007 | Honma et al. | |
| 2007/0157659 | A1 | 7/2007 | McPhail | |
| 2008/0302118 | A1 | 12/2008 | Chen et al. | |
| 2009/0133412 | A1 | 5/2009 | Narayanamurthy et al. | |
| 2009/0205355 | A1 | 8/2009 | Mihara | |
| 2009/0260387 | A1 | 10/2009 | DeFrancesco | |
| 2010/0031677 | A1 | 2/2010 | Lifson et al. | |
| 2010/0043475 | A1 * | 2/2010 | Taras | F25B 1/10 62/331 |
| 2010/0071391 | A1 | 3/2010 | Lifson et al. | |
| 2010/0083678 | A1 | 4/2010 | Lifson et al. | |
| 2010/0199707 | A1 | 8/2010 | Pearson | |
| 2010/0281894 | A1 | 11/2010 | Huff | |
| 2010/0326100 | A1 | 12/2010 | Taras et al. | |
| 2011/0005244 | A1 * | 1/2011 | Finney | B64D 13/08 62/87 |
| 2011/0048042 | A1 | 3/2011 | Chen et al. | |
| 2011/0094259 | A1 | 4/2011 | Lifson et al. | |
| 2011/0162829 | A1 * | 7/2011 | Xiang | C09K 5/063 165/234 |
| 2011/0239668 | A1 | 10/2011 | Qiao et al. | |
| 2012/0011866 | A1 | 1/2012 | Scarcella et al. | |
| 2012/0036854 | A1 | 2/2012 | Vaisman et al. | |
| 2012/0067055 | A1 | 3/2012 | Held | |
| 2013/0160472 | A1 * | 6/2013 | Klimpel | B64D 13/08 62/87 |
| 2013/0233003 | A1 | 9/2013 | Piesker et al. | |
| 2013/0318983 | A1 * | 12/2013 | Zhou | F02C 6/08 60/772 |

FOREIGN PATENT DOCUMENTS

| | | | |
|---|---|---|---|
| EP | 2642221 | A2 | 9/2013 |
| JP | 2008224118 | A | 9/2008 |

* cited by examiner

THERMAL MANAGEMENT SYSTEM CONTROLLING DYNAMIC AND STEADY STATE THERMAL LOADS

CROSS-REFERENCE TO RELATED APPLICATIONS

This application claims priority to U.S. Provisional Patent Application No. 62/109,699 filed Jan. 30, 2013, which is a continuation-in-part of U.S. patent application Ser. No. 14/109,416 filed Dec. 17, 2013, which claims priority to U.S. Provisional Patent Application No. 61/785,900 filed Mar. 14, 2013, the contents of which are hereby incorporated in their entirety.

FIELD OF TECHNOLOGY

An improved method of operating a cooling system in an aerospace application is disclosed, and more particularly, an improved method of operating the cooling system includes controlling dynamic and thermal loads in a thermal management system.

BACKGROUND

It has become increasingly desirable to improve cooling systems in aerospace applications. Typically, cooling systems provide air conditioning, refrigeration and freezer services, and the like for commercial and other aerospace systems. In general, various known options are available for providing cooling, but such options have drawbacks that limit the design options for aerospace applications.

One known option includes a vapor compression cycle. Vapor compression cycles pass a refrigerant through two-phase operation and can operate efficiently and take advantage of the thermal carrying capacity of a liquid, as opposed to a gas, as well as take advantage of the heat of vaporization of the liquid refrigerant. Thus, through portions of the vapor compression cycle, the cooling system can be much more compact when compared to a gas or air-based system because the fluid being carried is in liquid form. However, vapor compression cycles typically are limited to lower ambient temperature operation and may not provide useful solutions for high ambient temperature operation.

Another known option is a single-phase gas-based system using a gas such as air as the refrigerant. However although air can serve usefully as a refrigerant medium, air is not an efficient thermal fluid, as its heat capacitance is limited to a function of its mass flow rate and heat capacity. Thus, gas-based systems are typically less efficient than vapor compression systems and are typically, for that reason alone, larger than vapor compression systems. Additionally, air systems typically include significant duct passages in order to carry the amount of air that is desired to achieve the amount of cooling typically used for aerospace purposes.

To accommodate the wide range of possible ambient operating conditions of the aircraft, cooling systems for aerospace applications typically use a gas-based system. That is, although it is desirable to reduce mass and bulk in aircraft or aerospace applications, typical cooling systems nevertheless include a more bulky and less efficient gas-based system in order to cover the range of conditions that can be experienced.

Other known systems include carbon dioxide ($CO_2$) as a refrigerant which, when operated in trans-critical mode (i.e., spanning operation between super-critical to sub-critical), offer an opportunity to significantly reduce the overall size of the system due to significantly improved system efficiency.

However, known systems include significant start-up thermal inertia and there can be delays in initiating cooling.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

Figure 1:
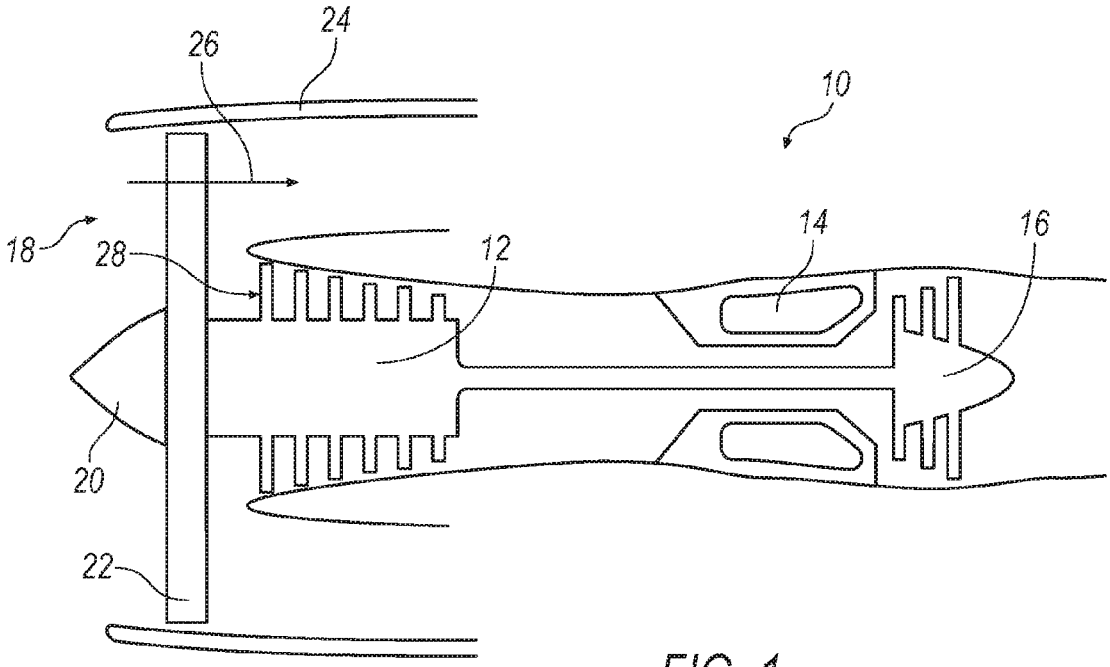
FIG. 1 is an illustration of a gas turbine engine employing the improvements discussed herein.

The disclosure relates to refrigeration systems, particularly, to thermal management systems dealing with electronics generating arbitrary significant dynamic loads in relatively short periods, and multiple steady-state loads with different operating temperatures.

Disclosed herein is a thermal management system (TMS) which cools a large dynamic load that may be activated for short periods of times, while cooling at least one steady-state load. The disclosed system includes a dynamic vapor cycle system (DVCS), a steady-state vapor cycle system (SS-VCS), and a thermal energy storage device (TES). The TES provides thermal contact with the dynamic load and has an interface with both VCS'. The dynamic load can perform cyclically or randomly. In one example of operation, the TES is kept fully charged by the VCS so it is ready for a dynamic load. When the dynamic load is activated, the DVCS is energized to re-charge the TES. When the TES is fully charged the DVCS shuts down. In one example, the TES is sized to cope with 100% of the dynamic load, and in another example the TES may be smaller than 100% of the load, which can be made up by sharing operation and load with the DVCS. In another example of operation, the SSVCS operates when the TMS is on, cooling steady-state loads operating at different temperatures while compensating for various thermal losses associated with thermal interaction of the TES with other components and with the ambient environment.

An exemplary cooling system is described herein, and various embodiments thereof. A cooling system includes a first cooling system and a second cooling system. The first cooling system includes a steady-state cooling circuit comprising a heat load heat exchanger, and a first heat rejection heat exchanger that rejects heat from each circuit. The second cooling system includes a dynamic cooling circuit having a second heat rejection heat exchanger that rejects heat from the dynamic cooling circuit. The cooling system includes a thermal energy storage (TES) system that thermally couples the first cooling system to the second cooling system and is configured to receive a dynamic thermal load, and a controller coupled to the first and second cooling systems and configured to operate the dynamic cooling circuit based on the dynamic thermal load.

The first cooling system may include two separate steady-state cooling systems, each comprising a respective heat load heat exchanger, and a respective first heat rejection heat exchanger common to both. One of these systems is configured to cool loads via the TES. The other one is configured to cool loads directly or via a secondary refrigerants, not via the TES; it may be configured as a single- or multi-evaporator systems depending on the available thermal loads.

The above mentioned two separate steady-state cooling systems may be implemented as one multi-evaporator system. In this case the first cooling system includes two steady-state cooling circuits, each comprising a respective heat load heat exchanger, and a first heat rejection heat exchanger common to the two steady-state cooling circuits that rejects heat from each circuit.

Another exemplary illustration includes a method of operating a cooling system includes receiving heat from a heat load heat exchanger of a steady-state cooling system, rejecting heat from the steady-state cooling system to a first heat rejection heat exchanger, and receiving heat from a dynamic thermal load in a dynamic cooling circuit. The method further includes rejecting heat from the dynamic cooling circuit in a second heat rejection heat exchanger, thermally coupling the steady-state cooling system and the dynamic cooling system in a thermal energy storage (TES) system, and operating the dynamic cooling system based on the dynamic thermal load.

The method of operating a cooling system may include receiving heat from two heat load heat exchangers of two separate steady-state cooling systems, rejecting heat from the two steady-state cooling systems to two first heat rejection heat exchangers. The method implies that one system cools loads via TES and the other one cool load directly or via secondary refrigerants, not via the TES.

The two separate steady-state cooling systems may be implemented as one multi-evaporator system. In this case the method of operating a cooling system includes receiving heat from two heat load heat exchangers within two respective steady-state cooling circuits, rejecting heat from the two steady-state cooling subsystems to a first heat rejection heat exchanger that is common to both.

An exemplary cooling system for an aircraft application is described herein, and various embodiments thereof. A cooling system includes a heat exchanger through which a refrigerant flows, and which rejects heat to a fluid, an evaporator, a first circuit having an expansion device, a second circuit having an expansion machine coupled to a compressor, and a set of valves arranged to direct the refrigerant through the first circuit, the second circuit, or both the first and second circuits based on ambient conditions.

Another exemplary illustration includes a method of operating a cooling system that includes operating a set of valves that cause a refrigerant to pass the refrigerant through a heat exchanger, and direct the refrigerant through a first cooling circuit, a second cooling circuit, or both depending on ambient conditions. The first cooling circuit includes an expansion device and the second cooling circuit includes an expansion machine.

Turning now to the drawings, FIG. 1 illustrates a schematic diagram of a gas turbine machine 10 that is a primary mover or thrust source for an aircraft, utilizing the improvements disclosed herein. The turbine machine 10 includes a primary compressor 12, a combustor 14 and a primary turbine assembly 16. A fan 18 includes a nosecone assembly 20, blade members 22 and a fan casing 24. The blade members 22 direct low pressure air to a bypass flow path 26 and to the compressor intake 28, which in turn provides airflow to compressor 12. Components of turbine machine 10 and as illustrated in FIG. 1 generally do not correspond to components of embodiments of the cooling system in subsequent figures. That is, components of FIG. 1 generally correspond to components of an aircraft engine, whereas components in the subsequent figures (i.e., turbine, compressor) are components dedicated to the cooling systems described and are separate from the components of turbine machine 10.

Figure 2:
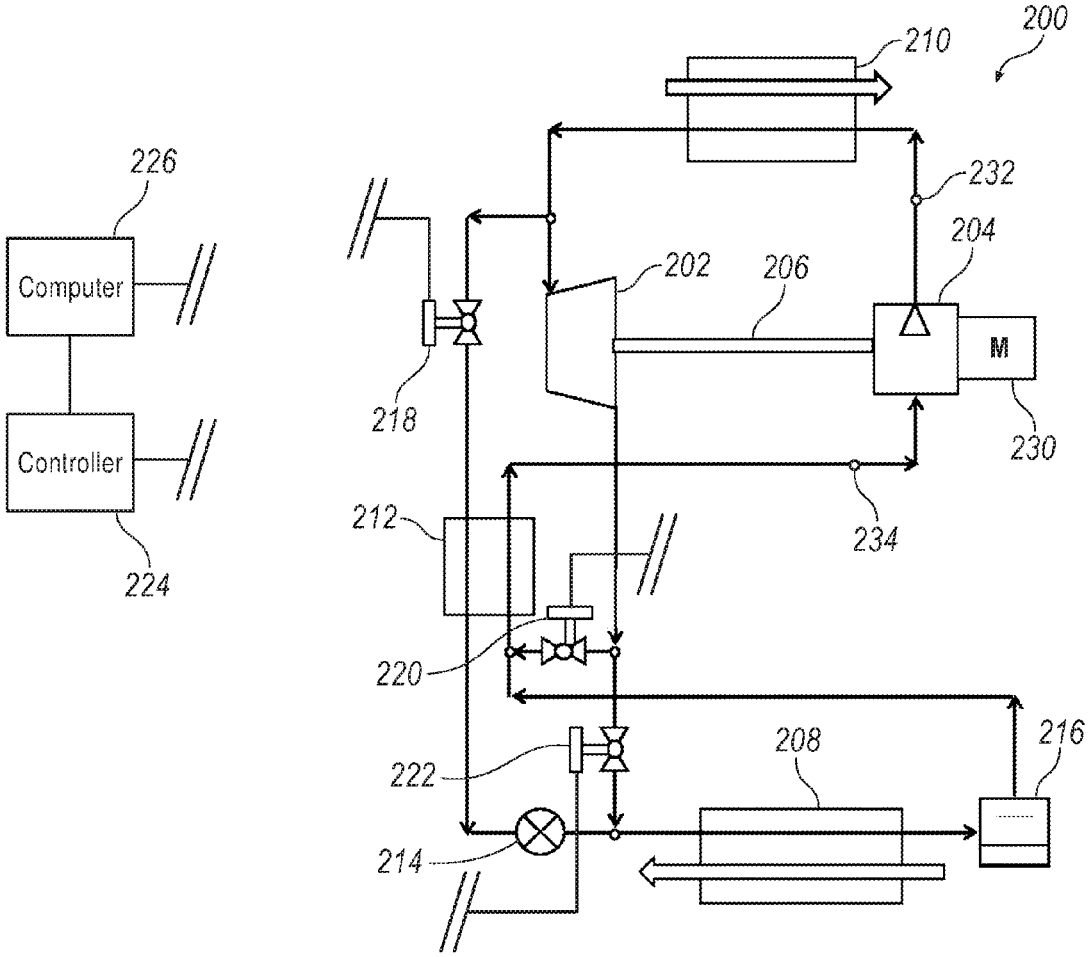
FIG. 2 is an illustration of a cooling system having optional valve-controlled refrigerant flow paths.

FIG. 2 illustrates a schematic diagram of a cooling system having valve-controlled refrigerant flow paths that are selected based on the heat rejection source and thermal loads. Cooling system 200 includes a refrigerant circuit with a compressor 204, a heat rejection exchanger 210, two parallel expansion circuits, an evaporator 208, and a suction accumulator 216. The heat rejection exchanger 210 is cooled by a cooling fluid and may operate as a condenser or a gas cooler. One expansion circuit has a valve 218, a recuperative heat exchanger 212, and an expansion device 214. The other expansion circuit with an expansion machine (expander or turbine) 202 has two lines downstream from the expander. One line having a valve 222 communicates directly with the evaporator 208. The other line feeds a low pressure side of the recuperative heat exchanger 212 and transfers its enthalpy to a high pressure stream feeding the evaporator 208 via the expansion device 214 when the valve 218 is open.

Cooling fluid states at the inlet to the heat rejection exchanger and thermal loads on the evaporator define the operating conditions of the cooling system.

The heat rejection heat exchanger 210 may be cooled by different fluids: air, fuel, RAM air, polyalphaolefin (PAO), water, any secondary refrigerant, fan bypass air or any available appropriate engine stream, as examples. As such, heat is rejected from system 200 via heat rejection heat exchanger 210, and the heat rejection rate is defined by parameters of state of the cooling fluid. Parameters of state of the cooling fluid depend on the application and the fluid itself. For instance, operating conditions of the aircraft may include low static ambient temperatures and low pressures that occur when the aircraft is at high altitude, while high static ambient temperatures and pressures may occur at low altitude or at conditions on a tarmac. These static ambient pressure and temperature, Mach Number, and pressure and temperature on the ground define the parameters of RAM air entering the heat rejection exchanger.

The expansion device 214 is an orifice, a thermal expansion valve, an electronic expansion valve, a capillary tube or any other device providing isenthalpic expansion.

The expander 202 is designed as a two-phase expander which means that the leaving state is a two-phase mixture; however, expander 202 can handle single phase processes in a vapor area. Expander 202 is coupled to compressor 204 via a rotational shaft 206. The power generated in the expander 202 may not sufficient to drive the compressor. Therefore, the compressor 204 employs a motor 230 to compensate insufficient power.

A heat source for evaporator 208 is associated with objects to be cooled (power electronics, HVAC for cabins and passenger compartments, and other mission systems, as examples). The evaporator 208 may cool air in a flight deck, a passenger compartment, or electronics. Alternatively evaporator 208 can cool any of those or all of those via a coolant, which could be PAO, water, a water glycol mixture, or any other secondary refrigerant. Objects to be cooled, such as electronic devices, may be mounted on cold plates, which has channels for boiling refrigerant to execute direct cooling by the refrigerant. The system may have multiple condensers using the same or different heat sinks. Also, the system may have multiple evaporators using the same or different heat sources and loads.

The suction accumulator 216 provides charge management and is part of the capacity control strategy. When the system cooling capacity exceeds the demand, the non-evaporated refrigerant is stored in the suction accumulator 216. In the case of a capacity shortage, the accumulated refrigerant evaporates and resumes operation.

The solenoid valves 218, 220, and 222 control operation thereof. In one embodiment, cooling system 200 includes a controller 224 that in one example is controlled by a computer 226. Valves 218, 220, and 222 are controlled and direct refrigerant flow according to the ambient conditions, or operating conditions of the aircraft.

Valves 218, 220, and 222, may be actuated electrically via solenoids, pneumatically, or by any other means. There is an option when the system does not have valve 220 and its related line. In this case the recuperative heat exchanger 212 is optional. Also, there is another option when the system does not have the valve 222 and its related line.

System 200 is designed to operate at a wide operating range of pressures and temperatures in the evaporator, below and above the critical point. The system may operate at evaporator pressures below the critical point to enable execution of heat absorption and cooling duty by boiling the refrigerant in evaporator 208.

The heat rejection can be processed above or below the critical point, via selected operation of valves 218, 220, and 222. If the heat rejection process is below the critical pressure (when the cooling fluid temperature is low) then the system operation is sub-critical and the heat rejection exchanger operates a condenser. Otherwise, when the cooling fluid temperature is high, the heat rejection exchanger operates a gas cooler, the system implements a trans-critical cycle providing that the evaporating pressure is still below the critical pressure.

During transient processes a combination of a load on the evaporator and cooling fluid temperature and heat rejection capability may move the evaporating pressure up above the critical point. In such cases the evaporator operates as a single phase heat exchanger, and these are the cases when the system operation is supercritical.

When cooling fluid temperature is high and pressure in the heat rejection exchanger is above the critical one, the isenthalpic expansion in the expansion valve 214 itself may not contribute a feasible cooling effect and the expansion in the expander 202 is dominant. If pressure in the evaporator is above or around the critical pressure (the supercritical mode) the valves 218 and 220 are closed; and valve 222 is open. If pressure in the evaporator is sufficiently below the critical pressure (trans-critical mode) the valves 218 and 220 are opened and the valve 222 is closed to avoid circulation of excessive amount of vapor through the evaporator and associated excessive refrigerant pressure drop.

When cooling fluid temperature is low enough to drive the compressor discharge pressure below the critical pressure the contribution of the expander degrades, the solenoid valves 220 and 222 may be closed. This occurs when the thermodynamic state leaving the expansion device 214 contains a feasible amount of liquid phase, or in other words, when the vapor quality of the refrigerant entering the evaporator is adequately low.

Thus, a control strategy is based upon pressures and vapor quality entering the evaporator.

One capacity control strategy includes sensing a refrigerant pressure on the high pressure side, a refrigerant temperature at the inlet to the expansion device 214, and a refrigerant pressure on the low pressure side. The pressure on the high side and the temperature at the inlet to the expansion device 214 define refrigerant enthalpy entering the evaporator; this enthalpy and the low side pressure define refrigerant vapor quality entering the evaporator.

In general, this control strategy includes appropriately positioned pressure (232 and 234) and a temperature sensor (not shown) at the inlet to the expansion valve 214. The sensors 232, 234 may shut the system off when the discharge pressure is above of a set head pressure limit or suction pressure is below a set suction pressure limit.

To distinguish supercritical operation the pressure sensor 234 is positioned on the suction side of compressor 204 (in systems having LP and high pressure HP compressors, it is typically the suction side of the LP compressor that is of controlling interest). If the evaporating pressure is above the critical pressure (or is slightly lower), solenoid valves 218, 220 are off and the system implements a supercritical cycle, particularly, a Brayton Cycle system, and a single phase stream leaving the expander feeds the heat exchanger 208.

The sensor 232 distinguishes trans-critical and sub-critical operation. Under low temperature cooling fluid conditions (i.e., in flight and at high elevation at temperatures where a refrigerant such as $CO_2$ may be a liquid), first valve 218 is open and second and third valves 220, 222 are closed to direct refrigerant flow through expansion valve 214 as a liquid (sub-critical operation). Under high temperature cooling fluid conditions (i.e., when the aircraft is parked or during low elevation flight, or during transition to high elevation and at temperatures where a refrigerant such as $CO_2$ is a gas) and thermal loads driving the pressure in the evaporator above the critical point, operation is altered to direct the refrigerant flow through expander 202 (supercritical operation) and valves 218, 220 are off. At other conditions (trans-critical operation) valves 218 and 220 are on and the valve 222 is off when the vapor quality is not low enough; the valve 218 is on and the valves 220 and 222 are off when the vapor quality is low enough.

Further, when expander 202 is operated as described and as it expands refrigerant therein, because of its rotational coupling to compressor 204, compressor 204 is thereby operated and driven by expander 202 in addition to the power input provided by an electrical drive. However, when expander 202 is bypassed (decoupled from the compressor and not rotated) and liquid refrigerant is passed to expansion device 214, compressor is thereby driven by an electrically driven motor 230 only.

$CO_2$ (carbon dioxide), which enables the trans-critical, sub-critical, and super-critical operation, is therefore a refrigerant of choice for use with system 200. It will be appreciated that another trans-critical, sub-critical and super-critical refrigerant could be employed. If there is a need to elevate the critical point and extend the two phase region in order to improve the overall system performance a $CO_2$ based mixture (such as $CO_2$ and propane) may be selected as a refrigerant. As such, $CO_2$ serves as a refrigerant that spans the range of operating conditions that may be experienced as changing ambient conditions of, for instance, the aircraft. Exiting the heat rejection exchanger $CO_2$ is a gas when the temperature and pressure are above the critical ones and is a liquid when the temperature and pressure are below the critical ones. When passed through first valve 218 to expansion device 214, $CO_2$ is in gaseous form (provided that the pressure after expansion is above the critical point) or in two-phase form (provided that the pressure after expansion is below the critical point). When passed through expander 202 with first valve 218 closed and as described above, $CO_2$ is in gaseous form (provided that the pressure after expansion is above the critical point) or in two-phase or vapor form (provided that the pressure after expansion is below the critical point).

Figure 3:
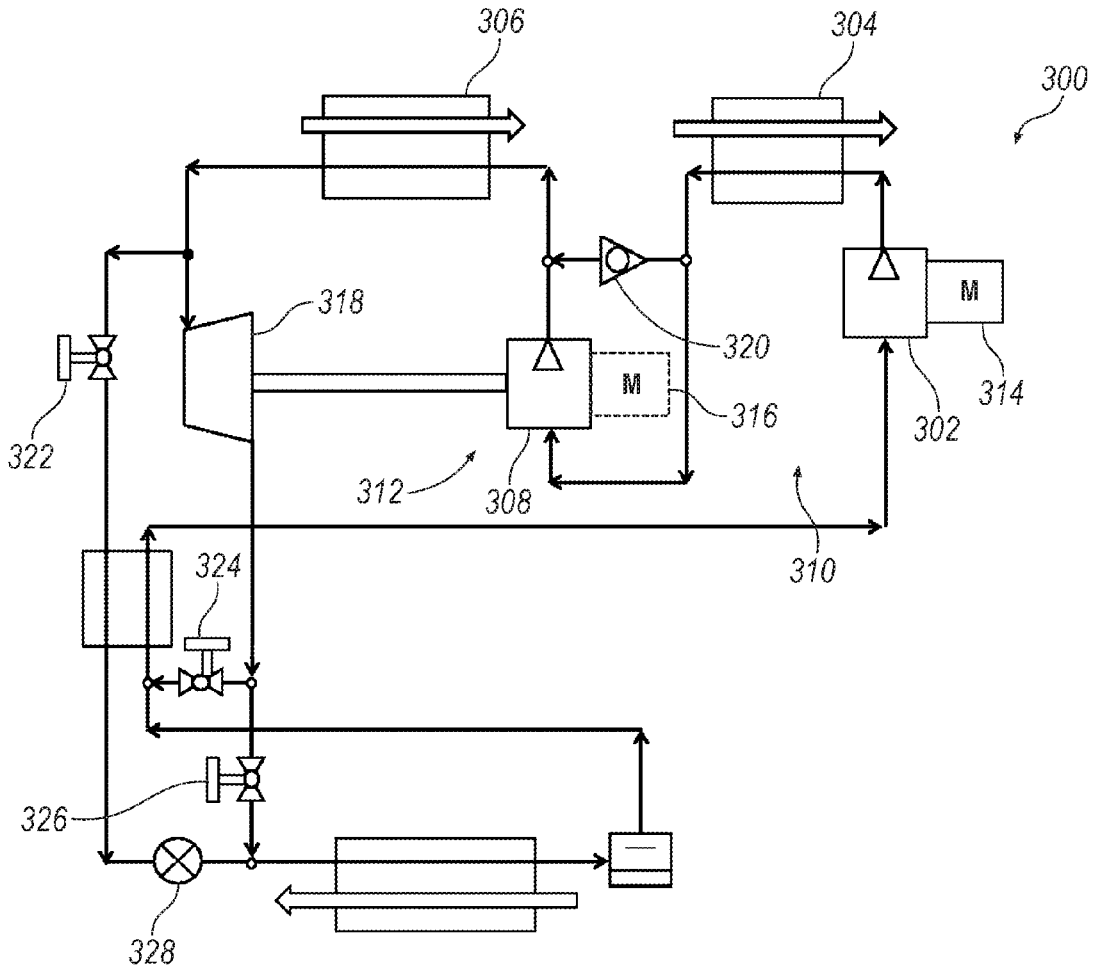
FIG. 3 is an illustration of a cooling system having a second compressor.

FIG. 3 illustrates a schematic diagram of an alternative cooling system having valve-controlled refrigerant flow paths that are selected based on ambient conditions or the operating conditions of the aircraft, according to another embodiment. Cooling system 300 operates in a fashion similar to that of cooling system 200 of FIG. 2, but the single stage compression is replaced by a two-stage compression. The two-stage compression may be implemented by a two-stage compressor or by a combination of a low pressure compressor and a high pressure compressor. The two-stage compression provides an opportunity to drive one compressor stage by the expander and other compressor by an electrical motor, such as motor 314. In one example, the low pressure compression stage, the high pressure compression stage, the expander, and the motor are sitting on the same shaft.

The cooling system includes a low pressure compressor 302, a high pressure compressor 308, and a gas cooler 304 in addition to those of FIG. 2. The gas cooler 304 (as the heat rejection exchanger 306) may be cooled by fuel, air, RAM air, PAO, water, or any other secondary refrigerant, fan bypass air, or any available appropriate engine stream. The expander 318 drives the high pressure compressor 308 and the low pressure compressor 302 is driven by an electrical motor. Alternatively, it is possible to arrange that the low pressure compressor is driven by the expander and the high pressure compressor is driven by the motor (illustrated as element 316 as dashed lines).

The heat rejection exchanger 306, comparable in location to that of heat rejection exchanger 210 of FIG. 2, may nevertheless differ in design and operation because of the two-stage heat rejection design of cooling system 300. Also, the heat rejection heat exchanger 306 may be combined with the gas cooler 304 and operate as one device. Similarly, a compressor 308 is positioned in a location that is comparable to compressor 204 of FIG. 2.

Operation of cooling system 300 is therefore two-stage in that refrigerant passes through compressor 302 in a first stage of compression 310, heat is rejected to gas cooler 304, and refrigerant is passed to the compressor 308 in a second stage of compression 312 before entering heat rejection heat exchanger 306. The compressor 302 is therefore designated as a low pressure (LP) compressor and the compressor 308 is a high pressure (HP) compressor, due to the pressures in their relative locations in the system 300.

In one embodiment a check valve 320 may be included to enable bypassing the compressor that is driven by the expander at certain combinations of low cooling fluid temperatures and thermal loads on the evaporator.

Cooling system 300 is operated in a fashion similar of system 200, but with the two stages of compression 310, 312 as discussed. System 300 is therefore operable via valves 322, 324, and 326 in the fashion as described in order to selectively operate expansion devices such as expander 308 and expansion device 328, depending on sub-critical, trans-critical, or super-critical operation.

Figure 4:
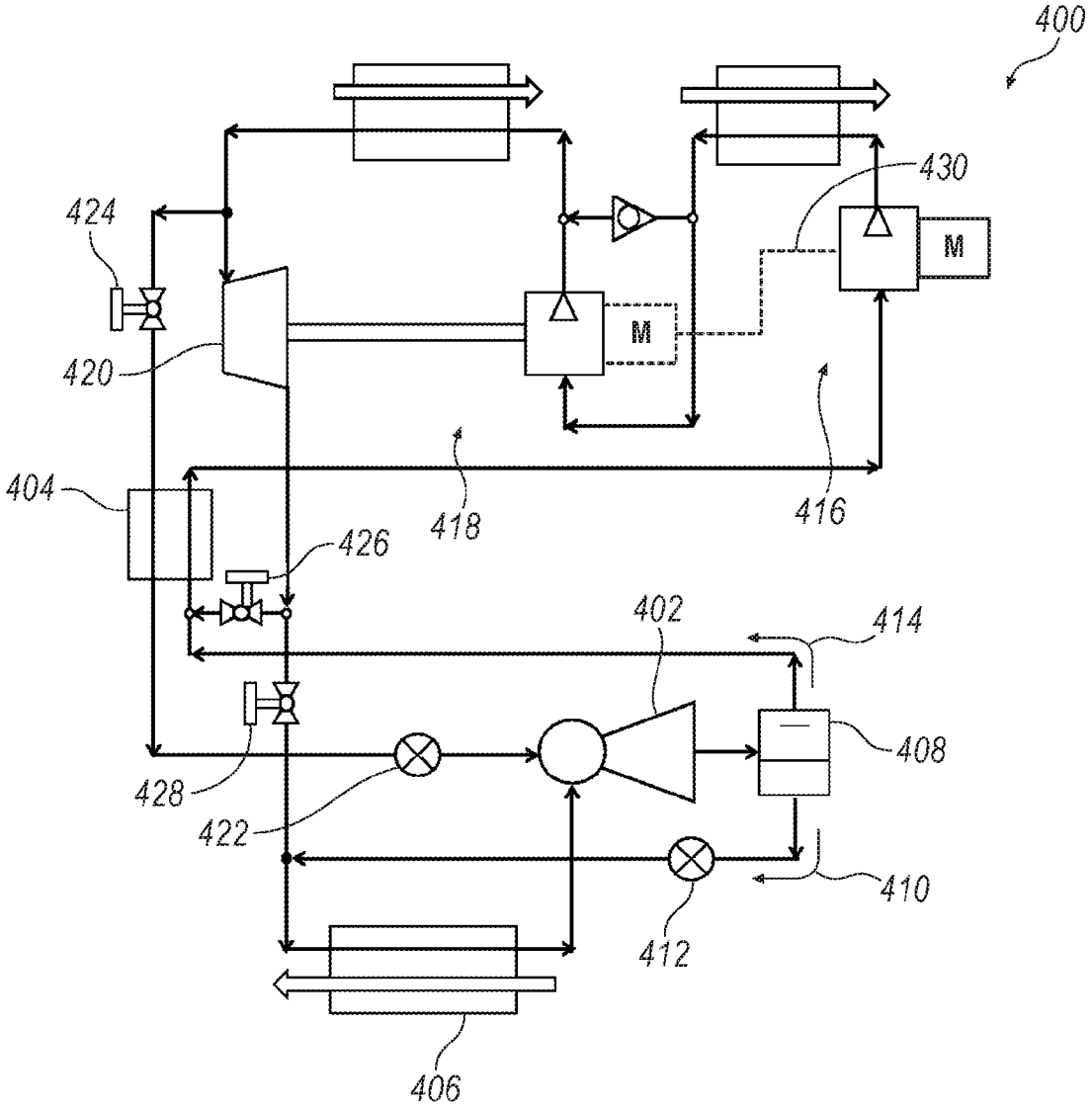
FIG. 4 is an illustration of a cooling system having an ejector for operating as a booster compressor.

FIG. 4 illustrates a schematic diagram of an alternative cooling system having valve-controlled refrigerant flow paths that are selected based on the ambient conditions or operating conditions of the aircraft. Cooling system 400 operates in a fashion similar to that of previously described cooling systems 200, 300, but includes an ejector 402 for boosting compression of the refrigerant before the refrigerant passes to the subsequent compression cycle(s). The ejector 402 is fed by a high pressure refrigerant stream when a solenoid valve 422 is open. This stream is a motive stream. The ejector expands the motive stream and using the energy of the motive stream drives/eject a low pressure stream from evaporator 406. The ejector discharges the refrigerant stream at a pressure higher than the evaporating pressure to a liquid separator 408 in which liquid is extracted 410, passed to expansion device 412 and then to evaporator 406. Refrigerant also passes from liquid separator 408 as a stream or vapor 414 and then passes to first stage compression 416 and to second stage compression 418, as described above with respect to cooling system 300. According to one embodiment, system 400 includes optional expansion device 422 that provides refrigerant expansion prior to entering ejector 402.

In addition to liquid separation function the liquid separator provides the charge management for capacity control instead of the suction accumulator. Thus, ejector 402 operates as an expansion device and a boost compressor, which boosts gas pressure prior to entering first stage 416, and leading to an overall decreased pressure differential across the compression stages, improving overall performance. System 400 is therefore operable via valves 424, 426, 428 in the fashion as described in order to selectively operate expansion devices, such as expander 420 and expansion device 422, depending on sub-critical, trans-critical, or super-critical operation.

Further, it is contemplated that ejector 402 may be used in a cooling system having, for instance, only a single stage of compression. For instance, as described above system 200 of FIG. 2 includes a single stage of compression, and thus in one embodiment ejector 402 as described with respect to system 400 of FIG. 4 may be included in systems in which one stage of compression is included. In addition, according to one alternative, both compressors may be coupled to one another through a shaft that is common to expansion device 420. In one example, system 400 includes a recuperative heat exchanger 404.

Figure 5:
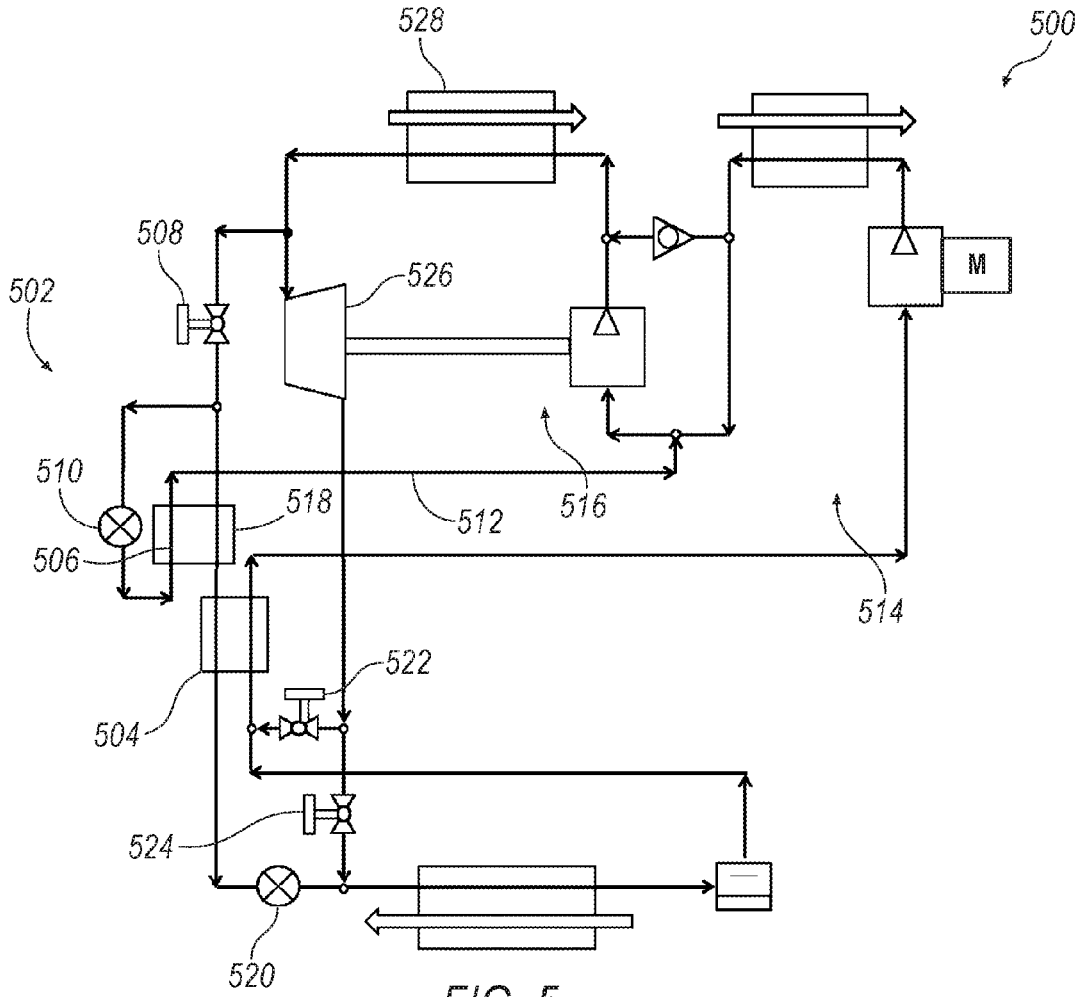
FIG. 5 is an illustration of a cooling system having a secondary expansion loop.

Referring to FIG. 5, an alternative cooling system 500 includes an economizer cycle 502 in which, in addition to recuperative heat exchanger 504 as in previous systems, a second recuperative heat exchanger 506 is included. The refrigerant, having passed through valve 508, is expanded in a separate expansion device 510, is passed through second recuperative heat exchanger 506, and is passed as an additional vapor line 512 to combine with refrigerant passing from first stage compression 514 to second stage compression 516. As such, overall system performance is improved as a portion of refrigerant stream passing through valve 508 is expanded in device 510, and passed through second recuperative heat exchanger 506 such that its component 518 is cooled yet further prior to entering heat exchanger 504 and expansion device 520. The second recuperative heat exchanger 506 enables additional cooling of high pressure stream which improves cooling capacity of the system recompressing refrigerant from intermediate pressure to high pressure. Economizer cycle 502 thus enhances the conditions for overall system cooling when valves 508, 522, and 524 are operated to bypass expander 526, increasing the refrigerant flow for heat rejection in condenser cooler or condenser 528.

The illustrated embodiment has a low pressure compressor and a high pressure compressor. Alternatively, the cooling system may have a compressor with an economizer port. The compressor may be placed on the same shaft with the expander 526 and a motor.

Figure 6:
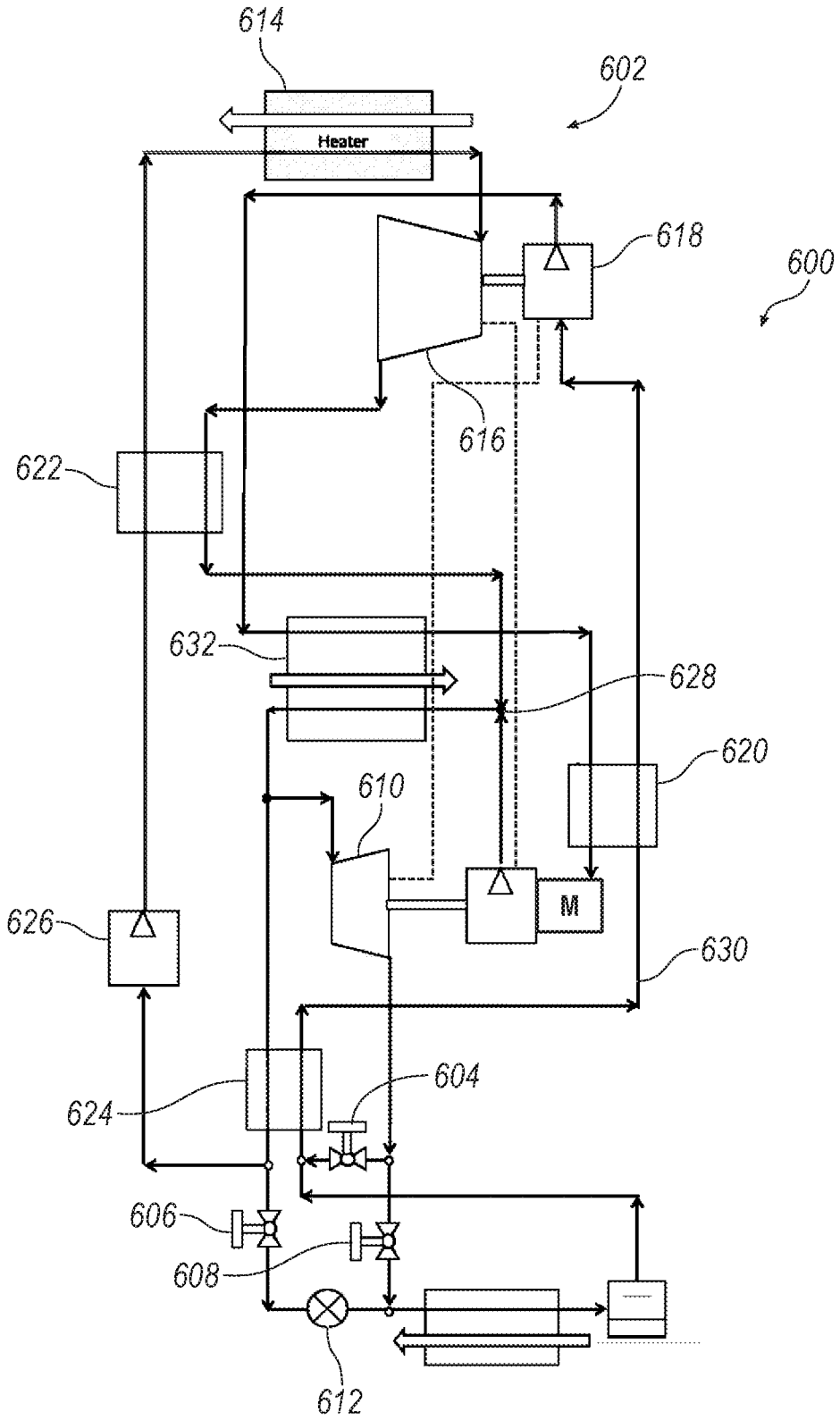
FIG. 6 is an illustration of a cooling system driven in part thermally by a waste heat source.

Referring to FIG. 6, an alternative cooling system 600 operates as described with the disclosed systems above, but with the additional benefit of a thermally driven portion 602 that is driven by waste heat from the aircraft, in one embodiment. The system incorporates power generation circuit and a cooling circuit such as described above. The power generation portion includes a pump 626 (providing that it has liquid or at least sufficiently dense refrigerant at its inlet), optional recuperative heat exchanger 622, a heater 614, an expander 616, and a heat rejection exchanger 632. The heat rejection exchanger 632 is a common component for both circuits as a heat rejection exchanger. Such embodiment provides an opportunity to drive the high pressure compressor stage by the two-phase expander 610 (by placing the high pressure compressor and the two-phase expander on the same shaft) and the low pressure compressor stage 618 by the vapor expander 616 (by placing the low pressure compressor and the vapor expander on the same shaft) without any electrical power input. In one example, the system includes one electrically driven device, pump 626. Alternatively, it is possible to arrange driving the low pressure compressor stage 618 by the two-phase expander 610 and the high pressure compressor stage by the vapor expander 616 (shown as dashed lines). There is an option to place the pump on one shaft with the expander 610 or with the expander 618 in order to avoid or reduce electrical input. Also, there is an option to place the low pressure compressor, the high pressure compressor, the two-phase expander, the vapor expander, and the pump on one common shaft. In addition a motor-generator may be added to the shaft to extract power when cooling capacity demands is reduced.

In another embodiment thermally driven portion 602 derives its heat not as waste heat, but from components in the aircraft or aircraft engine that operate at high temperature. In this case, including a motor-generator instead of a motor may be beneficial. The motor-generator may generate power when the cooling by the evaporator is not needed and cooling of a hot temperature source by the heater 614 is an option. Valves 604, 606, 608 may be operated in the fashion as described in order to selectively operate expansion devices such as expander 610 and expansion device 612, depending on sub-critical, trans-critical, or super-critical operation. However, in this embodiment waste heat from the aircraft is recovered via a heater 614, through which waste heat is passed (i.e., combustion products). Thermally driven portion 602 of system 600 includes expander 616 and a compressor 618, recuperative heat exchangers 620, 622, and 624, and pump 626. That is, in addition to the components of system 200 described with respect to FIG. 2, system 600 includes the additional components described that enable waste heat recovery from the aircraft, leading to higher system cooling output and more efficient operation.

In operation, liquid refrigerant is extracted after having passed through recuperative heat exchanger 624 and pumped via pump 626 through recuperative heat exchanger 622. The refrigerant is passed through heater 614 and the heated, high pressure refrigerant is expanded through expander 616 and power is extracted therefrom to drive compressor 618. Refrigerant that exits expander 616 passes through recuperative heat exchanger 622 and joins refrigerant flow from other portions of the circuit at junction 628. Refrigerant passing to thermally driving portion 602 arrives through refrigerant line 630, passes through recuperative heat exchanger 620, and to compressor 618, where the refrigerant is compressed and passed to heat rejection heat exchanger 632.

Heat rejection exchanger 632 is illustrated as a single device or heat exchanger, but in an alternate embodiment may be two separate heat exchangers (delineated as a dashed line) for power generation and cooling portions of the system, and it is contemplated that the heat rejection is to coolant designated as an arrow that, in the two separate heat exchanger embodiment, passes to each of them.

In such fashion, waste heat from the aircraft is recovered and its energy is available to improve system cooling output and overall system efficiency. Recuperative heat exchangers 620, 622, 624 are available as positioned to jointly heat and cool as refrigerant passes in their respective directions, taking yet more advantage of the waste heat available to the system. Further, it is contemplated that all embodiments illustrated and described herein are controllable via a controller and computer, as described with respect to FIG. 2 above (with controller 224 and computer 226).

In an alternate embodiment, expander 610 is coupled to compressor 618, and compressor 616 is likewise coupled to the HP compressor as illustrated in the alternative provided that the check valve is repositioned accordingly.

Figure 7:
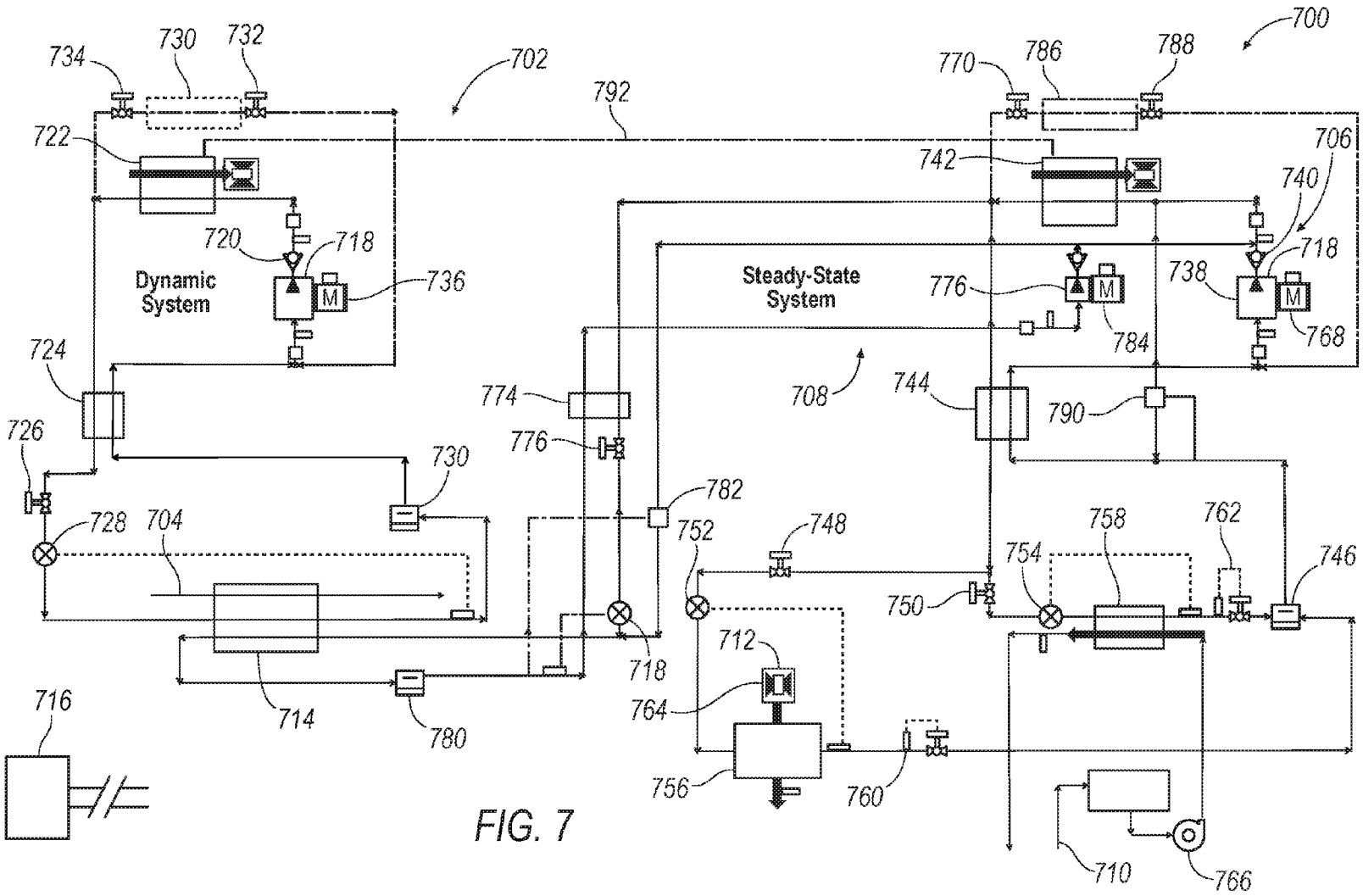
FIG. 7 is illustrates a thermal management system having a dynamic system and two steady state systems.

FIG. 7 illustrates a thermal management system (TMS) 700, having a dynamic system 702 which handles a dynamic load 704, and two steady state systems 706, 708 that handle respectively a steady state load 710 and a steady state load 712. In the disclosed case all three systems use the same refrigerant, but, optionally each system may operate on different refrigerants. The steady state load 712 may represent a load that is generally stable over time, such as direct or indirect cooling stationary, mobile, or aerospace electronics, or conditioning air. Dynamic load 704 can perform cyclically or randomly, which may be a relatively heavy but intermittent load that occurs such as a cyclical on-off cooling system for a building that may be subject to, for instance, an intermittent heat load that is not readily predictable.

Steady state load 712 is via air, and steady-state load 710 is via a secondary refrigerant, such as, propylene glycol-water mixture, ethylene glycol water mixture, PAO, or others. TMS 700 therefore includes a dynamic vapor cycle system (DVCS) 702, steady-state vapor cycle systems (SS-VCS) 706, 708, a thermal energy storage device (TES) 714, and a controller 716 that controls valve operation, compressor operation, and the like. Optionally SSVCS may have two separate vapor cycle sub-systems.

TES 714 is a heat exchanger that includes a TES material such as wax or other material that can store energy, including via a phase change material which, as known in the art, stores and releases energy at a phase change temperature while changing phase from, for instance, a liquid to a solid. TES 714 is in communication with TMS 700 via channels of fluids communicating with dynamic load 704, channels of the dynamic VCS 702, and channels of the SSVCS system 708. The channel of fluids communicating with dynamic load 704 may operate using a secondary refrigerant in a single phase (such as air, propylene-glycol water mixture, ethylene-glycol water mixture, PAO, or any other), or refrigerant processed in a two-phase region (which is condensed in the channels and evaporates contacting the dynamic load). The channels of the dynamic VCS 702 and the channels of the SSVCS systems 708 carry the evaporating refrigerant.

TMS 700 may employ DVCS 702 and/or SSVCS systems 706, 708 operating on conventional refrigerants and implementing a sub-critical thermodynamic cycle. FIG. 7 illustrates a trans-critical DVCS 702 and SSVCS systems 706, 708 operating on any refrigerant, which may extend its operational borders above its critical point. In the example illustrated, this description implies $CO_2$. However, as stated, TMS 700 may employ systems having conventional refrigerants, or having trans-critical operation with a refrigerant such as $CO_2$.

DVCS 702 operates when a dynamic load is activated. It cools electronics indirectly via the material within TES 714, and charges the TES 714 directly cooling the TES material. When the TES 714 is fully charged the DVCS 702 shuts down.

When the DVCS 702 is OFF the SSVCS systems 706, 608 alone cool the steady-state loads 710, 712 and the TES 714 to compensate the TES thermal loads established by the thermal interaction between the TES 714, fluids in the TES, related components and the ambient environment.

The DVCS 702 has a closed circuit with a compressor 718, a check valve 720, a heat rejection exchanger 722, a recuperative heat exchanger 724, a solenoid valve 726, an expansion device 728, related channels of the TES as illustrated, and a suction accumulator 730. As discussed, the disclosed system may employ conventional refrigerants or trans-critically operating refrigerants such as $CO_2$, and the illustrated system is described with respect to $CO_2$. Accordingly, TMS 700 illustrates a receiver circuit that includes a receiver 730. Receiver 730 is illustrated in dash lines to show that it is optional, and is typically included in a system employing a trans-critical operation.

Charge management receiver 730 is installed in parallel to compressor 718 and heat rejection exchanger 722. The receiver 730 has two ports 732, 734: one port with corresponding solenoid valve 732 is exposed to a suction side of compressor 718; and the other port with corresponding solenoid valve 734 exposed to the compressor discharge side.

Compressor 718 of the DVCS 702 may be integrated with a motor 736 as one semi-hermetic unit. Compressor 718 includes a low pressure switch and a high pressure switch to prevent the compressor operation at extremely low or high operating pressures respectively. Also compressor 718 may have pressure and temperature sensors at the compressor suction and discharge sides as shown. Solenoid valve 726 upstream expansion valve 728 is normally opened. Charge management solenoid valves 732, 734 are normally closed.

When the TES 714 material solidifies and is fully charged, the load on the DVCS and the suction/evaporating pressure substantially drop and the low pressure sensor shuts down the DVCS. The check valve 720 and the normally closed solenoid valve prevent any fluid interaction between the evaporator and the rest of the system when the DVCS is OFF.

SSVCS systems 706, 708 are a multi-evaporator system having two main closed circuits. The first main circuit includes a relatively large compressor 738, a check valve 740, a heat rejection exchanger 742, a recuperative heat exchanger 744, two parallel circuits as illustrated that correspond generally with loads 710, 712, and a suction accumulator 746. Each parallel circuit has a respective solenoid valve 748, 750, expansion device 752, 754, evaporator 756, 758, and back pressure regulator 760, 762. Solenoid valves 748, 750 in each circuit are optional; and other options are to either have only one common solenoid valve, or no valve at all. In the illustrated and exemplary embodiment, evaporator 756 provides thermal contact between evaporating refrigerant and air that is being cooled. Evaporator 756 is installed in a duct downstream of a fan 764 pushing air through evaporator 756. Evaporator 758 is a heat exchanger which provides thermal contact between evaporating refrigerant and a secondary refrigerant in the pumping loop as shown, using pump 766.

Compressor 738 may be integrated with a motor 768 as one semi-hermetic unit. Compressor 738 has a low pressure switch and a high pressure switch to prevent compressor operation at extremely low or high operating pressures, respectively. Also compressor 738 may have pressure and temperature sensors, as shown, at suction and discharge sides.

A hot gas bypass circuit includes a hot gas bypass valve (HGPV) 770 that connects the compressor discharge side from compressor 738 and the suction line at the inlet to the low pressure side of a recuperative heat exchanger 744. HGPV 770 includes a pressure sensor which senses pressure in the suction line as shown.

The second main circuit 706 includes a small compressor 772, the heat rejection exchanger 742, a recuperative heat exchanger 774, a filer-drier (not shown), a solenoid valve 776, an expansion valve 778, related $CO_2$ channels of the TES, and a suction accumulator 780. A hot gas bypass circuit having a hot gas bypass valve (HGBV) 782 connects the compressor discharge side and the inlet to the TES evaporator channels. HGBV 782 includes a pressure sensor which senses pressure in the suction line.

Compressor 772 may be integrated with a motor 784 as one semi-hermetic unit. Compressor 772 has a low pressure switch and a high pressure switch to prevent the compressor operation at extremely low or high operating pressures respectively. Also it may have pressure and temperature sensors at compressor suction and discharge sides. The high pressure switch and high pressure and temperature sensors may be shared with the compressor 738.

A circuit with a charge management receiver 786 is installed in parallel to compressor 738 and heat rejection exchanger 742. Receiver 786 has two ports: one is exposed to the compressor suction side and the other is exposed to the compressor discharge side. A solenoid valve is attached to each port, 788, 790.

HGBV 782 in the compressor circuit that includes compressor 772, connects the compressor discharge side and the suction line at the inlet to the related $CO_2$ channels of the TES 714.

Solenoid valves 748, 776 upstream the respective expansion devices 752, 778 are normally opened. The charge management solenoid valves 788, 790 are normally closed.

Each VCS 702, 706/708 may have its own heat rejection exchanger 722, 742, as shown. Optionally, each system may have its own heat rejection exchanger. Each heat rejection exchanger 722, 742 has a fan, as shown, and the fan is installed in a duct. Each fan is placed downstream from the heat rejection exchanger 722, 742 to keep air temperature entering the exchanger as low as possible. In one exemplary embodiment, both heat rejection exchangers 722, 742 may have a common fan. Yet another embodiment may imply the heat rejection exchanger as a common device for the DVCS and the SSVCS where a portion of the heat exchanger has channels of the DVCS circuit and another portion has channels of the SSVCS. That is, in one example heat rejection exchangers 722, 742 are common, as illustrated by dashed line 792.

Accordingly, a cooling system includes a first cooling system and a second cooling system. The first cooling system includes two steady-state cooling circuits, each comprising a respective heat load heat exchanger, and a first heat rejection heat exchanger common to the two steady-state cooling circuits that rejects heat from each circuit. Optionally, the first cooling system may be configured as two separate steady-state cooling systems and each system may have its own heat rejection exchanger. The second cooling system includes a dynamic cooling circuit having a second heat rejection heat exchanger that rejects heat from the dynamic cooling circuit. The cooling system includes a thermal energy storage (TES) system that thermally couples the first cooling system to the second cooling system and is configured to receive a dynamic thermal load, and a controller coupled to the first and second cooling systems.

A method of operating a cooling system includes receiving heat from two heat load heat exchangers within two respective steady-state cooling circuits, rejecting heat from the two steady-state cooling circuits to a first heat rejection heat exchanger that is common to both, and receiving heat from a dynamic thermal load in a dynamic cooling circuit. The method further includes rejecting heat from the dynamic cooling circuit in a second heat rejection heat exchanger, thermally coupling the two steady-state cooling circuits and the dynamic cooling circuit in a thermal energy storage (TES) system, and operating the dynamic cooling system based on the dynamic thermal load.

Methods of operation and control include the following exemplary strategies:

1. When a dynamic load is ON, the DVCS 702 is establishing a certain evaporating temperature and related pressure in a transient process. When the dynamic load is OFF the thermal load reduces since it arrives from TES 714 only and, therefore, the evaporating pressure and related evaporating temperature reduce. When TES 714 is fully charged the thermal load wanes and the evaporating and suction pressures abruptly go down. When the suction pressure reaches a set low pressure limit the low pressure switch shuts the dynamic VCS compressor OFF and the controller sends a signal to the solenoid valve downstream the expander to close.

The closed solenoid valve 726 upstream expansion valve 728 and check valve 720 at the compressor discharge side prevent hot high pressure refrigerant from moving to the cold channels of TES 714. This reduces the melting rate of the two-phase material within TES 714 when the DVCS 702 is OFF. When the dynamic load is activated, controller 716 sends a signal to open the solenoid valve 726 and, after a short delay, sends a signal to energize compressor 718.

2. Performance of the DVCS is very sensitive to the refrigerant charge. The charge management receiver 730 operates as storage of redundant refrigerant charge. To increase the cooling capacity a portion of the refrigerant charge is moved from the charge management receiver 730 to a respective main circuit. If the cooling capacity is too high a portion of the refrigerant charge is moved from the main circuit to the receiver 730.

Circulating charge is controlled sensing compressor discharge pressure. An optimal discharge pressure maximizing coefficient of performance (COP) depends on ambient temperature and evaporating temperature sensed via suction pressure. Controller 716 defines an optimal or desired discharge pressure. If the discharge pressure is above the pressure associated with current ambient temperature the solenoid valve 734 of the charge management receiver 730 exposed to the compressor discharge side opens and a certain charge moves from the main circuit to the charge management receiver. This happens when the ambient temperature reduces. The removed refrigerant charge decreases the cooling capacity and balances it with the demand.

If compressor discharge pressure is below the pressure associated with current ambient temperature, the solenoid valve 732 of the charge management receiver 730 exposed to the compressor suction side opens and a certain charge moves from charge management receiver 730 to the main circuit. This happens when the ambient temperature increases or when the DVCS 702 loses some refrigerant due to leakage. The added refrigerant charge increases the cooling capacity and balances it with the demand.

3. When the TMS 700 is OFF, the solenoid valve 726 is de-energized. If ambient temperature is extremely low a portion of $CO_2$ may condense and fill the suction accumulator 730, which is located at the lowest point of the DVCS. In such case, when TMS 700 starts, controller 716 first sends signals to energize a solenoid valve downstream the expansion valve 728 to close it, and to power an electrical heater built-in in the suction accumulator 730. Then, after a delay allowing evaporation of the refrigerant in the suction accumulator 730, controller 716 sends signals to de-energize that solenoid valves and start the compressor 718.

4. The steady-state systems (SSVCS) 706, 708 may operate at different ambient temperatures than that of the DVCS 702. Even when the loads remain the same the changed ambient temperature may have an impact on the system performance.

In one example, the SSVCS systems 706, 708 are sized for a worst case load—the highest ambient temperature. If ambient temperature reduces the SSVCS systems 706, 708 provide excessive cooling capacity. The excessive capacity reduces superheat at the exits from the evaporators 756, 758. The expansion valve and back pressure regulators sense the pressures and temperatures at the exits from the related evaporators 756, 758, the controller 716 calculates the superheat at each exit and sends signals to each actuating device in order to reduce the cross-section areas of the orifices of the above mentioned control valves. As a result the mass flow rates through the evaporators 756, 758 and the evaporator capacities reduce to match the capacity demand.

5. When the load is reduced to such extent that the suction pressure of either compressor 738 or compressor 772 reduces below a set point, the controller 716 opens an orifice of the related hot gas bypass valve 770, 782.

The HGBV 770 of circuit 706 directs the hot high pressure refrigerant after the compressor 738 to the inlet to the low pressure side of recuperative heat exchanger 744. The hot gas reduces the cooling effect in the high pressure side of the recuperative heat exchanger 744, and ultimately reduces the capacity of the steady-state evaporators 756, 758.

The HGBV 782 of circuit 708 directs the hot high pressure refrigerant after compressor 772 to the inlet of the evaporator 714. The hot gas introduces an additional thermal load on the evaporator 714 and reduces the cooling effect in the related TES $CO_2$ channels.

6. The performance of the steady-state systems 706, 708 is sensitive to the refrigerant charge circulating in both circuits. The circulating charge is controlled by sensing compressor discharge pressure. As it was previously mentioned, the optimal discharge pressure depends on ambient temperature. If the discharge pressure is above the pressure associated with current ambient temperature the solenoid valve 790 of the charge management receiver 786 exposed to the compressor discharge side opens and a certain charge moves from the main circuits to the charge management receiver 786. If the discharge pressure is below the pressure associated with current ambient temperature the solenoid valve 788 of the charge management receiver exposed to the compressor suction side opens and a certain charge moves from charge management receiver to the main circuit.

7. The suction accumulators 746, 780 store non-evaporated refrigerant exiting evaporators, which may occur during transient processes.

When the TMS 700 is OFF the solenoid valves are de-energized. If ambient temperature is extremely low a portion of $CO_2$ may condense and fill the suction accumulators 746, 780, which are located at the lowest point of the SSVCS. In this case the TMS 700 executes a cold start-up. When the TMS 700 starts, the controller 716 first sends signals to energize the solenoid valves 750, 762 downstream the expansion devices 752, 754 and the solenoid valve 748 upstream the expansion valve to close them, and to power electrical heaters built-in in the suction accumulators. Then, after a delay allowing the evaporation of the refrigerant in the suction accumulators, the controller sends signals to de-energize those solenoid valves and, after a short delay, to start the compressors 738, 772.

Figure 8:
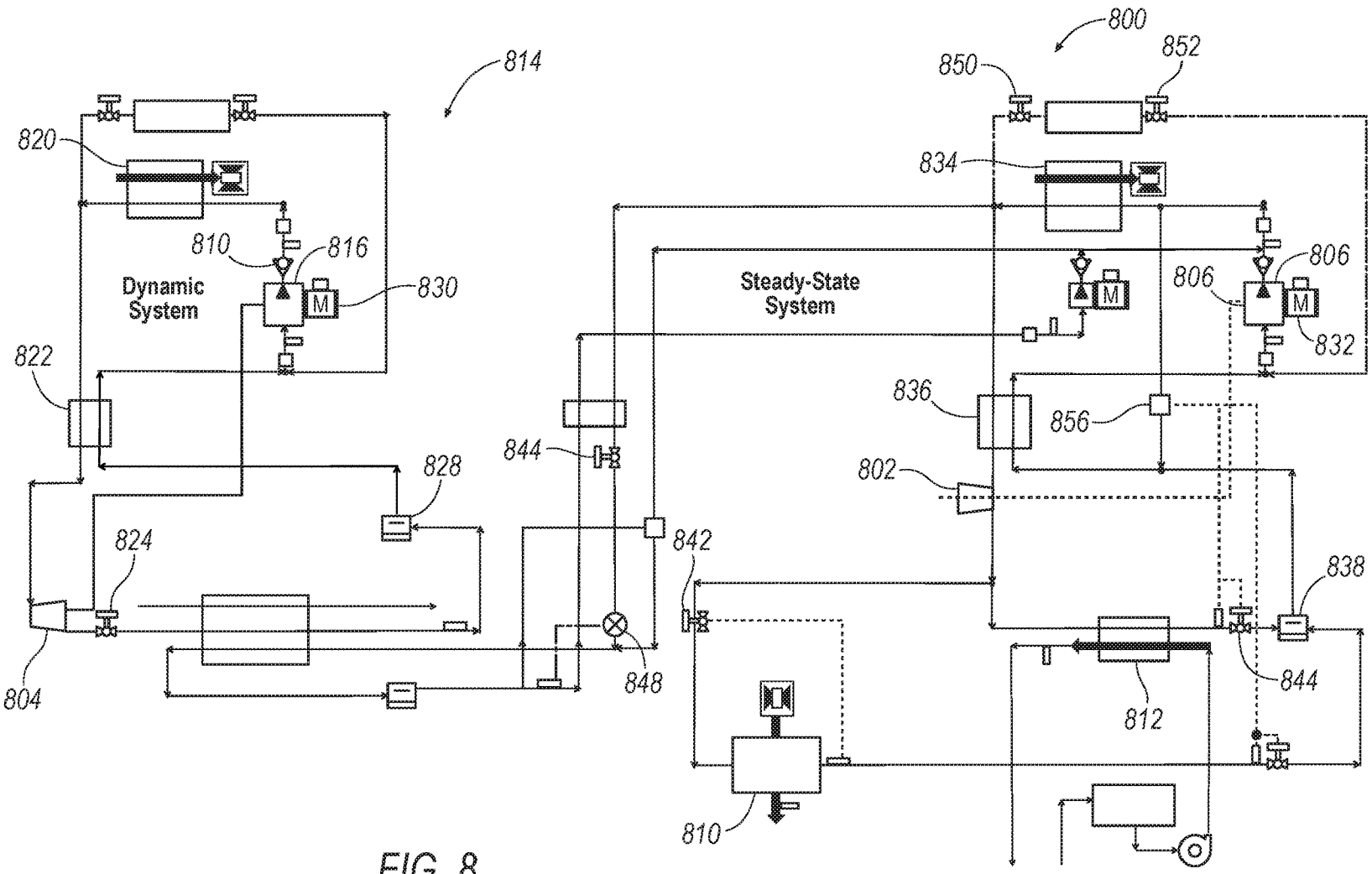
FIG. 8 is an illustration of a thermal management system employing a trans-critical CO2 cycle handling the same thermal loads.

FIG. 8 illustrates a TMS 800 employing a trans-critical CO2 cycle handling the same thermal loads. In accordance with this disclosure, TMS 800 employs expanders 802, 804 replacing the expansion device 728 in the DVCS and the expansion devices 752, 754 feeding evaporators 756, 758 in the SSVCS as shown in FIG. 7. The expanders 802, 804 expand refrigerant from the high pressure to the low pressure and generate power. A compressor 806 and expander 802 may be placed on the same shaft 808 and the generated power will reduce the net power required to drive the compressor 806. Because the expansion in the expander 802 does not have throttling losses inherent for isenthalpic expansion devices, the expander 802 improves the refrigerating effect in the evaporators 810, 812. The improved refrigeration effect and reduced compressor power significantly increase COP.

The DVCS has a main closed circuit 814 with a compressor 816, a check valve 818, a heat rejection exchanger 820, a recuperative heat exchanger 822, expander 804, a solenoid valve 824, the related CO2 channels of a TES 826, and a suction accumulator 828. The compressor 816, the expander 804, and a motor 830 may be implemented as one semi-hermetic unit. The unit has a casing, two inlet ports and two exit ports as illustrated. A pair of the inlet and exit ports is for the compressor 816 and the other is for the expander 804. The compressor 816 has low pressure and a high pressure switches to prevent the VCS operation at extremely low or high operating pressures respectively. In addition the compressor 816 has pressure and temperature sensors at compressor suction and discharge sides.

The first main circuit of the SSVCS is different from the equivalent circuit of FIG. 7 and includes a large compressor 806, a check valve 832, heat rejection exchanger 834, a recuperative heat exchanger 836, expander 802, two parallel circuits (having the compressor 772 and equivalent flow paths of FIG. 7), and a suction accumulator 838. Each circuit has a solenoid valve 840, 842, evaporators 810, 812, and back pressure regulators 844, 846.

The solenoid valves 840 and 842 in each circuit are optional; other options are: one common solenoid valve or no valve. Each evaporator circuit has an evaporator, pressure and temperature sensors, and a back pressure control valve.

The compressor 806, the expander 802, and motor 832 may be implemented as one semi-hermetic unit. The unit has a casing, two inlet ports and two exit ports as shown. One pair of the inlet and exit ports are for the compressor 806 and the second pair of the inlet and outlet ports are for the expander 802. The compressor 806 has low pressure and high pressure switches to prevent the VCS operation at extremely low or high operating pressures respectively. In addition the compressor 806 has pressure and temperature sensors at the compressor suction and discharge sides.

The solenoid valves 840, 842 downstream the expander 802 and a solenoid valve 844 upstream an expansion valve 848 are normally opened. Charge management solenoid valves 850, 852 are normally closed. Each back pressure control valve 844, 846 controls the upstream pressure and indirectly the refrigerant flow through the evaporators 810, 812 sensing the superheat (pressure and temperature) at the evaporator exit.

The back pressure regulators 844, 846 increase the opening and the refrigerant flow rate through it if superheat is above a certain set high value and decreases the opening and the refrigerant flow rate through it if superheat is below a certain set low value. Hot gas bypass line 854 directs refrigerant to the low pressure inlet to recuperative heat exchanger 836. A HGBV 856 senses superheat at both evaporator exits and pressure in the low pressure side of the steady-state VCS. HGBV 856 controls pressure in the low pressure side as well.

At the same time if at least one superheat at the evaporator exit is below a certain set value the HGBV opens. The high pressure refrigerant entering the expander becomes hotter, the steady-state VCS cooling capacity slightly reduces and this helps to match the set superheats at both evaporator exits. If at least one superheat is above a certain value the HGBV closes. The high pressure refrigerant entering the expander becomes colder, the steady-state VCS cooling capacity slightly reduces and this helps to match the set superheats at both evaporator exits.

If one superheat is below a certain set value and the second superheat is above a certain value, the HGBV does not act and the superheat is fully controlled by the back pressure regulators. The ability to control superheat enables implementation of the charge management using the charge management receiver.

Use of thermal energy storage for handling dynamic loads mitigates thermal inertia of vapor cycle systems. The TES 826 may be ready instantly while the VCS start-up time takes time. Also, controlling operation of VCS during start-up is very difficult task, if possible at all.

The DVCS manages the dynamic load indirectly via TES 826 while the SSVCS manages the steady state loads directly. Therefore, a VCS cooling the dynamic load should generate a lower evaporating temperature than a VCS cooling the steady state loads. Employment of two vapor cycle systems, DVCS and SSVCS, reduces power required to execute all cooling duties.

Use of trans-critical carbon dioxide vapor cycle systems (TCO2 VCS) may significantly reduce dimensions and weight of TMS. TCO2 VCS operate at high discharge and suction pressures. This fact, outstanding properties of CO2, and properly designed thermodynamic cycles are the key factors for reduction of dimensions and weights of TMS. In addition, if the TMS should operate at elevated heat rejection temperatures, the advanced TCO2 VCS may provide a better COP than the conventional refrigeration cycles.

Figure 9:
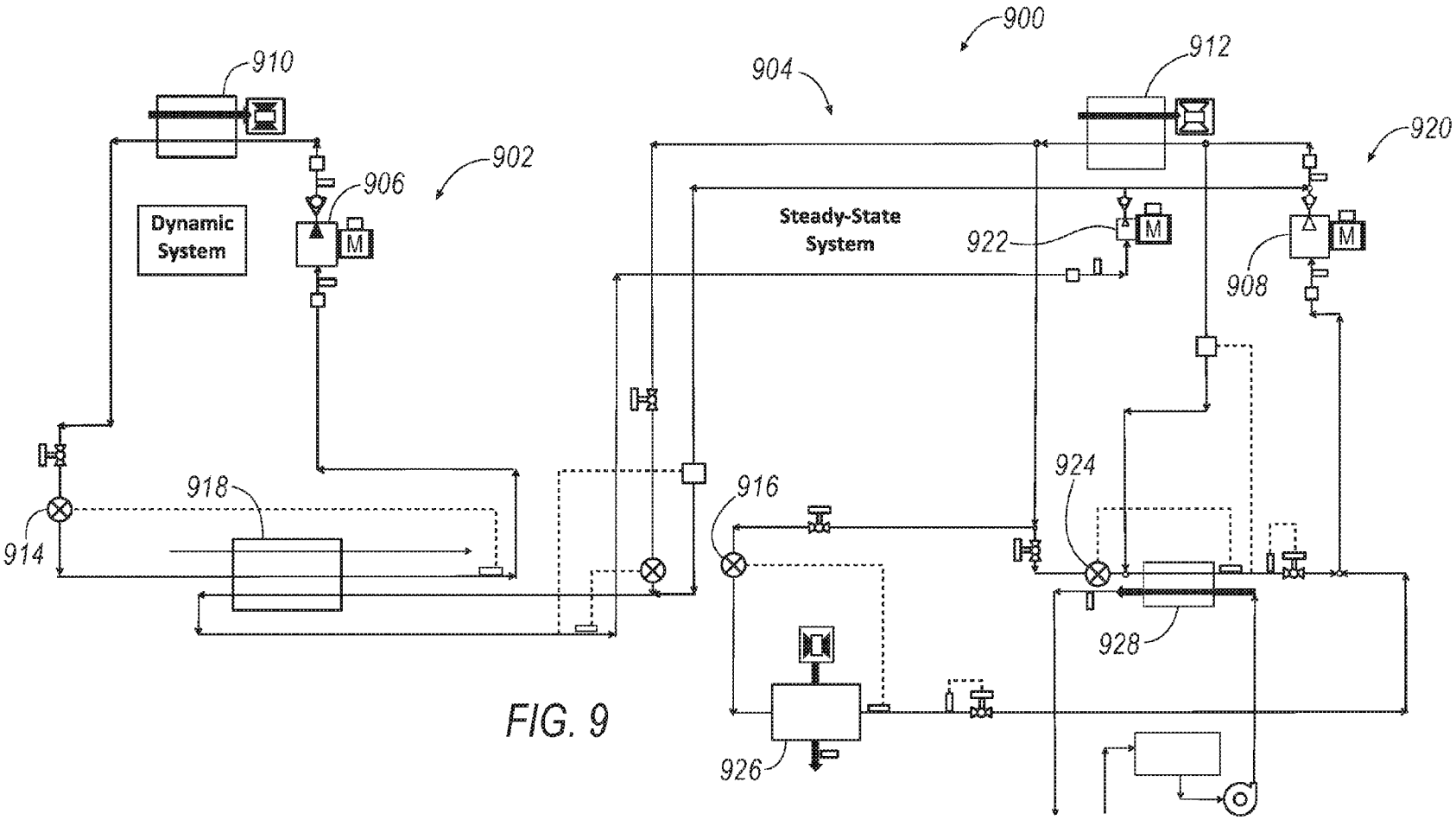
FIG. 9 is an illustration of a thermal management system employing a conventional vapor cycle system operating on a conventional refrigerant.

FIG. 9 is an illustration of a thermal management system employing a conventional vapor cycle system operating on a conventional refrigerant and handling similar thermal loads as in other disclosed embodiments. Referring to FIG. 9, a conventional steady-state and dynamic thermal management system 900 is illustrated. System 900 operates on a conventional sub-critical refrigerant and includes a closed dynamic cooling circuit 902, and a closed first steady-state circuit 904. Each circuit 902, 904 includes its own compressor 906, 908, heat rejection exchanger 910, 912 operating as condensers, and expansion device 914, 916. A thermal energy storage (TES) system 918 is configured to receive a dynamic load, and thermally couples dynamic cooling circuit 902 and first steady-state circuit 904. The dynamic cooling circuit 902 is configured to cool the TES 918 to fully absorb thermal energy received by the TES 918 when a dynamic thermal load is ON. The steady-stated circuit 904 is configured to cool the TES 918 when the dynamic thermal load is OFF.

System 900 includes a closed second steady-state cooling circuit 920 having its own compressor 922 and expansion device 924. Each of the first and second steady-state cooling circuits 904, 920 includes a respective evaporator 926, 928.

In general, computing systems 226 and/or devices, such as the processor and the user input device, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX® operating system distributed by International Business Machines of Armonk, N.Y., the Linux® operating system, the Mac® OS X and iOS operating systems distributed by Apple Inc. of Cupertino, Calif., and the Android® operating system developed by the Open Handset Alliance.

Computing devices 226 generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C®, C++®, Visual Basic®, Java Script®, Perl®, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein. With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A thermal management system, comprising:

a closed dynamic trans-critical cooling circuit having a respective compressor, heat rejection heat exchanger, and expansion device; and a closed first steady-state trans-critical cooling circuit having a respective compressor, heat rejection heat exchanger, and expansion device;

a thermal energy storage (TES) system configured to receive a dynamic load and thermally couple the dynamic trans-critical cooling circuit and the first steady-state trans-critical cooling circuit;

wherein:

the dynamic trans-critical cooling circuit is configured to cool the TES to absorb thermal energy received by the TES when a dynamic thermal load is ON;

the first steady-state trans-critical cooling circuit is configured to cool the TES when the dynamic thermal load is OFF; and the trans-critical cooling circuits include $CO_2$ as a refrigerant.

2. The system as claimed in claim 1, further comprising:

a closed second steady-state trans-critical cooling circuit having a respective compressor, expansion device, and evaporator;

wherein the evaporator for the second steady-state trans-critical cooling circuit is configured to receive a steady-state thermal load.

3. The system as claimed in claim 2, wherein the first and second trans-critical steady-state cooling circuits are combined and operate with a common heat rejection heat exchanger.

4. The system as claimed in claim 2, further comprising a controller configured to operate the dynamic trans-critical cooling circuit based on the dynamic thermal load and to operate the first and second steady-state circuits based on steady-state thermal loads.

5. The system as claimed in claim 2, wherein each expansion device expands the refrigerant at a constant enthalpy.

6. The system as claimed in claim 5, wherein at least one expansion device is an expander mechanically coupled with a respective compressor.

7. The system as claimed in claim 2, wherein at least one of the first and second steady-state trans-critical cooling circuits includes a hot gas bypass valve (HGBV) at an outlet to a respective compressor, and the HGBV is positioned to divert hot gas from the respective compressor to a respective low pressure side.

8. The system as claimed in claim, 2, wherein at least one of the trans-critical cooling circuits includes a receiver that operates as storage for a redundant refrigerant charge.

9. The system as claimed in claim 2, wherein the evaporator for the second steady-state trans-critical cooling circuit is configured to receive the steady-state thermal load via a fluid circulating between its evaporator and at least one object generating a steady-state thermal load.

10. The system as claimed in claim 1, wherein the TES includes a phase change material.

11. The system as claimed in claim 1, wherein the TES is configured to receive the dynamic thermal load via a fluid circulating between the TES and at least one object generating the dynamic load.

12. The system as claimed in claim 11, wherein the fluid is condensed contacting the TES and at least portion of the fluid evaporates contacting the thermal load.

13. The system as claimed in claim 1, wherein a low pressure sensor at the low pressure side of the dynamic vapor cycle system shuts down the dynamic trans-critical cooling circuit when the TES material solidifies.

14. The system as claimed in claim 1, wherein a solenoid valve upstream to the evaporator and a check valve at the compressor discharge side prevents fluid interaction between the evaporator and the rest of the system when the dynamic trans-critical cooling system is OFF.

15. The system as claimed in claim 1, wherein at least one trans-critical cooling circuit is a multi-evaporator system.

16. The system as claimed in claim 1, wherein at a least one component of the cooling system is integrated with a turbine engine.

17. The system as claimed in claim 1, wherein at a least one component of the cooling system is integrated with an aircraft.

18. A method of operating a thermal management system, comprising:

thermally coupling a dynamic trans-critical cooling circuit with a steady-state trans-critical cooling circuit via a thermal energy storage (TES) system, wherein each of the cooling circuits has a respective compressor, heat rejection exchanger, and expansion device;

receiving a dynamic load in the TES;

cooling the TES to absorb thermal energy by the TES when the dynamic thermal load is ON; and cooling the TES with the steady-state cooling circuit when the dynamic thermal load is OFF.

19. The method of claim 18, further comprising receiving a steady-state thermal load in an evaporator, wherein the evaporator is in a second steady-state trans-critical cooling circuit having a respective compressor, heat rejection exchanger, expansion device, and the evaporator.

* * * * *